US011585171B2

(12) United States Patent
DeBoer

(10) Patent No.: US 11,585,171 B2
(45) Date of Patent: Feb. 21, 2023

(54) MANAGED PRESSURE DRILLING SYSTEMS AND METHODS

(71) Applicant: Kryn Petroleum Services LLC, Richmond, TX (US)

(72) Inventor: Luc DeBoer, Richmond, TX (US)

(73) Assignee: Kyrn Petroleum Services LLC, Richmond, TX (US)

( * ) Notice: Subject to any disclaimer, the term of this patent is extended or adjusted under 35 U.S.C. 154(b) by 0 days.

(21) Appl. No.: 17/272,195

(22) PCT Filed: Sep. 3, 2019

(86) PCT No.: PCT/US2019/049350

§ 371 (c)(1),
(2) Date: Feb. 26, 2021

(87) PCT Pub. No.: WO2020/047543

PCT Pub. Date: Mar. 5, 2020

(65) Prior Publication Data

US 2021/0310321 A1 Oct. 7, 2021

Related U.S. Application Data

(60) Provisional application No. 62/725,935, filed on Aug. 31, 2018.

(51) Int. Cl.
*E21B 21/00* (2006.01)
*E21B 21/08* (2006.01)
(Continued)

(52) U.S. Cl.
CPC ..... *E21B 21/08* (2013.01); *E21B 21/001* (2013.01); *E21B 21/103* (2013.01); *E21B 34/10* (2013.01); *E21B 44/06* (2013.01)

(58) Field of Classification Search
CPC ..... E21B 21/001; E21B 21/08; E21B 21/082; E21B 21/103; E21B 34/10; E21B 44/06
See application file for complete search history.

(56) References Cited

U.S. PATENT DOCUMENTS 3,268,017 A * 8/1966 Yarbrough ..... E21B 21/12 175/25
8,978,774 B2 * 3/2015 Fossli ..... E21B 43/38 166/363

(Continued)

FOREIGN PATENT DOCUMENTS

CN 1932234 A * 3/2007
KR 10-2010-0116073 A 10/2010

(Continued)

OTHER PUBLICATIONS

International Search Report and Written Opinion dated Dec. 20, 2019 for Application No. PCT/US2019/049350.

*Primary Examiner* — Matthew R Buck
(74) *Attorney, Agent, or Firm* — Conley Rose, P.C.

(57) ABSTRACT

A well system includes a drilling vessel, a concentric drillstring extending from the vessel into a subterranean wellbore disposed beneath a mudline, wherein the concentric drillstring is configured to circulate a drilling fluid from the drilling vessel into the wellbore along a first passage, and to circulate the drilling fluid from the wellbore to the drilling vessel along a second passage, and a subsea pump in fluid communication with the wellbore, wherein the subsea pump is configured to manage fluid pressure in the wellbore by controlling a height of a column of hydrostatic fluid disposed in the wellbore.

22 Claims, 4 Drawing Sheets

(51) Int. Cl.

| | |
|---|---|
| ***E21B 21/10*** | (2006.01) |
| ***E21B 34/10*** | (2006.01) |
| ***E21B 44/06*** | (2006.01) |

(56) References Cited

U.S. PATENT DOCUMENTS

| | | | | |
|---|---|---|---|---|
| 9,057,236 | B2 * | 6/2015 | Hogset | E21B 21/08 |
| 9,187,968 | B2 * | 11/2015 | Hole | E21B 21/08 |
| 10,246,954 | B2 * | 4/2019 | Zhou | E21B 21/12 |
| 2016/0076306 | A1 | 3/2016 | Fossli | |
| 2017/0044856 | A1 | 2/2017 | Leuchtenberg et al. | |
| 2017/0058632 | A1 * | 3/2017 | deBoer | E21B 15/02 |

FOREIGN PATENT DOCUMENTS

| | | | | |
|---|---|---|---|---|
| KR | 10-2013-0089540 | A | 8/2013 | |
| WO | WO-2006118920 | A2 * | 11/2006 | E21B 47/10 |

* cited by examiner

MANAGED PRESSURE DRILLING SYSTEMS AND METHODS

CROSS-REFERENCE TO RELATED APPLICATIONS

The present application is a 35 U.S.C. § 371 national stage application of PCT/US2019/049350 filed Sep. 3, 2019, entitled "Managed Pressure Drilling Systems and Methods", which claims benefit of U.S. provisional patent application No. 62/725,935 filed Aug. 31, 2018, entitled "Managed Pressure Drilling Systems and Methods," both of which are incorporated herein by reference in their entirety for all purposes.

STATEMENT REGARDING FEDERALLY SPONSORED RESEARCH OR DEVELOPMENT

Not applicable.

BACKGROUND

Well systems include a wellbore or well extending into a subterranean, hydrocarbon bearing formation. The wellbore of offshore well systems extend beneath a sea floor and may include a wellhead mounted at the sea floor for providing access to the well and for supporting equipment of the well system mounted thereto. In some applications, a marine riser extends between a blowout preventer (BOP) coupled to the wellhead at the sea floor and a rig or platform disposed at a sea surface, where the riser provides a conduit for a string, such as a drillstring, to extend from the rig into the wellbore, as well as an annulus conduit for circulating drilling fluid between the drilling rig and the wellbore. In certain applications, the drilling fluid comprises a weight or density configured to prevent an influx of formation fluids into the wellbore. Thus, the drilling fluid may have a weight designed to provide a fluid pressure in the wellbore that is both greater than the pore pressure of the formation and less than a fracture pressure of the formation. In deep-water offshore applications, the differential between the pore and fracture pressures of the formation at a given depth may be reduced due to increased overburden from the water depth. The decreased differential in deep-water applications may, in-turn, require the more frequent installation of relatively short casing joints in the wellbore (i.e., a decreased drilling interval) during the drilling operation to isolate sections of the wellbore from wellbore pressure, thereby increasing the amount of time and cost required to perform the drilling operation.

BRIEF SUMMARY OF THE DISCLOSURE

An embodiment of a well system comprises a drilling vessel; a concentric drillstring extending from the vessel into a subterranean wellbore disposed beneath a mudline, wherein the concentric drillstring is configured to circulate a drilling fluid from the drilling vessel into the wellbore along a first passage, and to circulate the drilling fluid from the wellbore to the drilling vessel along a second passage; and a subsea pump in fluid communication with the wellbore, wherein the subsea pump is configured to manage fluid pressure in the wellbore by controlling a height of a column of hydrostatic fluid disposed in the wellbore. In some embodiments, the hydrostatic fluid has a greater density than the drilling fluid. In some embodiments, the well system further comprises a marine riser extending from the drilling vessel, wherein the column of hydrostatic fluid is disposed at least partially in an annulus formed between an outer surface of the concentric drillstring and an inner surface of the marine riser. In certain embodiments, the well system further comprises a rotating control device (RCD) positioned along the marine riser and configured to seal against an outer surface of the concentric drillstring while permitting relative rotation between the drillstring and the marine riser. In certain embodiments, the RCD divides the annulus into an upper annulus in which air is disposed and a lower annulus in which at least a portion of the column of hydrostatic fluid is disposed. In some embodiments, the well system further comprises a choke manifold disposed on the drilling vessel, wherein the choke manifold is configured to apply backpressure to the drilling fluid flowing from the wellbore to the drilling vessel through the second passage of the concentric drillstring. In some embodiments, a lower end of the concentric drillstring comprises a valve configured to provide fluid communication between the wellbore and the second passage of the concentric drillstring.

An embodiment of a method of drilling a wellbore comprises (a) pumping a drilling fluid from a drilling vessel into a wellbore through a first passage in a drillstring; (b) flowing the drilling fluid from the wellbore to the drilling vessel through a second passage in the drillstring; and (c) pumping a first hydrostatic fluid into the wellbore using a subsea pump to manage fluid pressure in the wellbore. In some embodiments, the method further comprises (d) pumping the hydrostatic fluid into a marine riser through which the drillstring extends to manage fluid pressure in the wellbore. In some embodiments, the method further comprises (d) applying backpressure to the drilling fluid flowing from the wellbore to the drilling vessel through the second passage in the drillstring using a choke manifold disposed on the drilling vessel. In certain embodiments, the method further comprises (d) forming a bubble of drilling fluid in the wellbore, wherein the first hydrostatic fluid is positioned above the bubble of drilling fluid in the wellbore. In certain embodiments, the first hydrostatic fluid has a greater density than the drilling fluid. In some embodiments, the method further comprises (d) pumping the first hydrostatic fluid out of the wellbore using the subsea pump; and (e) pumping a second hydrostatic fluid into the wellbore using the subsea pump, wherein the second hydrostatic fluid has a greater density than the first hydrostatic fluid.

An embodiment of a well system comprises a drilling vessel; a drillstring extending from the vessel into a subterranean wellbore disposed beneath a mudline, wherein the drillstring is configured to circulate a drilling fluid from the drilling vessel into the wellbore along a first passage to form a bubble of drilling fluid positioned in the wellbore; and a subsea pump in fluid communication with the wellbore, wherein the subsea pump is configured to manage fluid pressure in the wellbore by controlling a height of a column of hydrostatic fluid disposed in the wellbore and positioned above the bubble of drilling fluid. In some embodiments, the hydrostatic fluid has a greater density than the drilling fluid. In some embodiments, the drillstring comprises a concentric drillstring configured to circulate the drilling fluid from the wellbore to the drilling vessel along a second passage. In certain embodiments, the well system further comprises a marine riser positioned about the drillstring, and wherein the column of hydrostatic fluid is disposed at least partially in the marine riser. In certain embodiments, the well system further comprises a choke manifold disposed on the drilling vessel, wherein the choke manifold is configured to apply backpressure to the drilling fluid flowing from the wellbore to the drilling vessel through the second passage of the drillstring. In some embodiments, a lower end of the drillstring comprises a valve configured to provide fluid communication between the wellbore and the second passage of the drillstring. In some embodiments, the well system further comprises a rotating control device (RCD) positioned along the marine riser and configured to seal against an outer surface of the drillstring while permitting relative rotation between the drillstring and the marine riser.

BRIEF DESCRIPTION OF THE DRAWINGS

For a detailed description of the various exemplary embodiments disclosed herein, reference will now be made to the accompanying drawings in which.

DETAILED DESCRIPTION OF EXEMPLARY EMBODIMENTS

Figure 1:
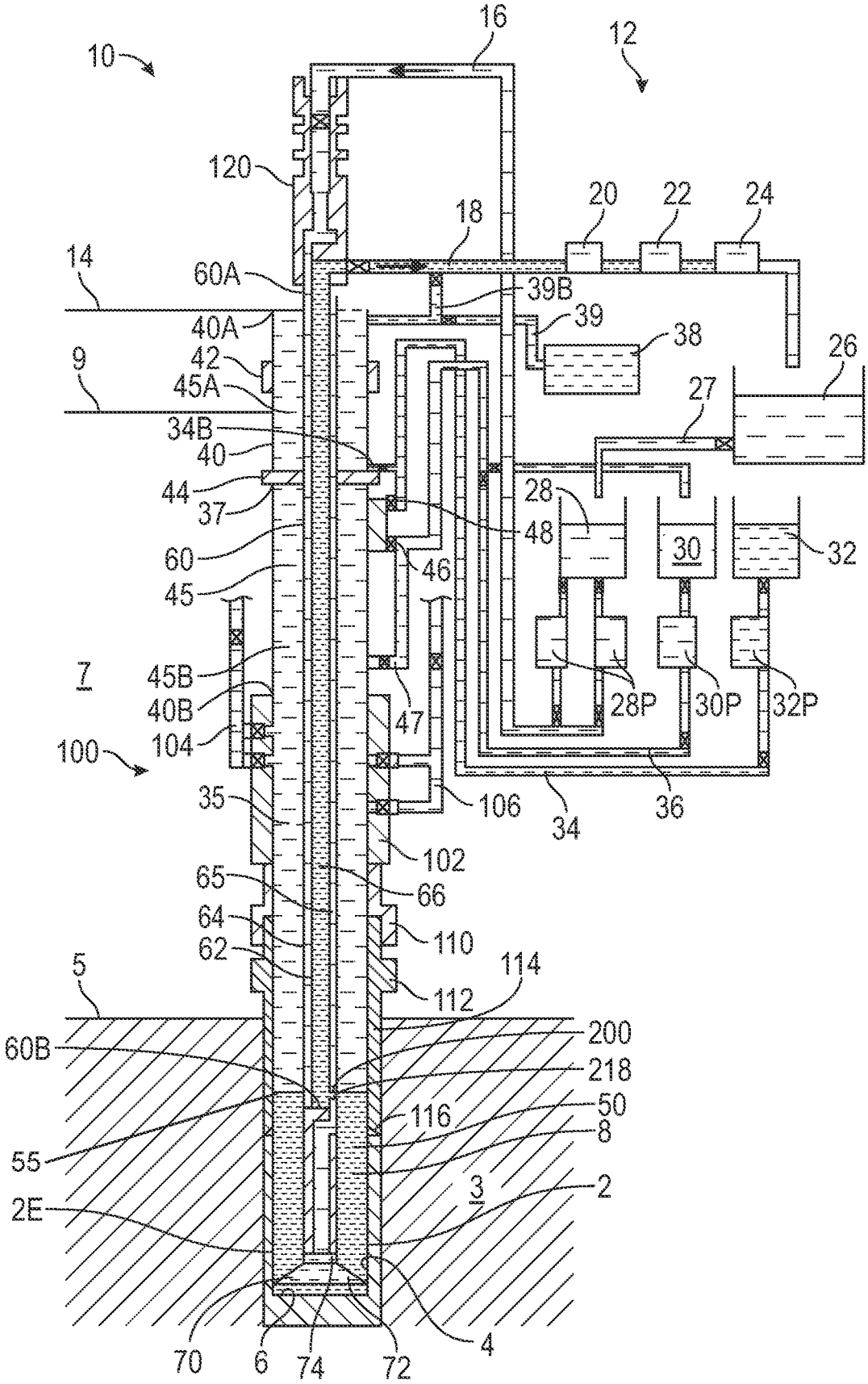
FIG. 1 is a schematic view of an embodiment of a well system in accordance with principles disclosed herein.

The drawing figures are not necessarily to scale. Certain features of the disclosure may be shown exaggerated in scale or in somewhat schematic form, and some details of conventional elements may not be shown, all in the interest of clarity and conciseness. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

The following discussion is directed to various embodiments of the disclosure. One skilled in the art will understand that the following description has broad application, and the discussion of any embodiment is meant only to be exemplary of that embodiment, and not intended to intimate that the scope of the disclosure, including the claims, is limited to that embodiment.

Referring to FIG. 1, an embodiment of a well or drilling system 10 is shown schematically in FIG. 1. Drilling system 10 is generally configured to form a wellbore or borehole 2 in an earthen subterranean formation 3 extending beneath a sea floor or mudline 5. In the embodiment shown in FIG. 1, drilling system 10 comprises an offshore drilling system 10, and thus, mudline 5 is disposed beneath a body of water or sea 7 defined by a sea level or waterline 9. Drilling system 10 generally includes a surface platform or drilling vessel 12 disposed above the waterline 9, a drillstring 60 extending into wellbore 2 from the vessel 12, and a wellhead system 100 disposed proximal the mudline 5. Vessel 12 includes a rig floor 14 disposed above the waterline 9 and configured to physically support equipment disposed on the vessel 12. Vessel 12 also includes a first or inlet conduit 16 and a second or return conduit 18. During operation of drilling system 10, inlet conduit 16 provides a flowpath for fluids to be injected into a first or upper end 60A of drillstring 60 for circulation to wellbore 2 while return conduit 18 provides a flowpath for fluids to be recirculated from wellbore 2 to the vessel 12 via drillstring 60.

In the embodiment shown in FIG. 1, return conduit 18 includes a choke manifold 20 for managing fluid pressure in return conduit 18, a degasser 22 for removing gas from a fluid flow passing through conduit 18, and one or more shale shakers 24 for removing cuttings and other debris from fluid flowing through return conduit 18. The fluid circulated through return conduit 18 is stored in one or more mud pits 26 disposed on the rig floor 14 of vessel 12. In the embodiment shown in FIG. 1, vessel 12 of drilling system 10 additionally includes a first or drilling fluid tank 28, a second or hydrostatic tank 30, and a third or seawater tank 32, where tanks 28, 30, and 32 are in fluid communication with corresponding pumps 28P, 30P, and 32P, respectively, for pumping fluid therefrom. An outlet 27 of mud pit 26 supplies drilling fluid tank 28 with the conditioned drilling fluid stored in mud pit 26. Drilling fluid tank 28 may be filled with a fluid having a same or different density than a fluid disposed in hydrostatic tank 30. In this embodiment, drilling fluid tank 28 is filled with a drilling fluid having a density of approximately 12.5 pounds per gallon (PPG), hydrostatic tank 30 is filled with a hydrostatic fluid having a density of approximately 14.0 PPG, and seawater tank 32 is filled with seawater having a density of approximately 8.6 PPG; however, in other embodiments, tanks 28, 30, and 32 may be filled with various fluids having varying densities and other fluid properties. In some embodiments, the drilling fluid stored in drilling fluid tank 28 and the hydrostatic fluid stored in hydrostatic tank 30 each comprise drilling fluids or oil based muds; however, in other embodiments, the composition of the drilling fluid, hydrostatic fluid, as well as the fluid stored in seawater tank 32, may vary. In the arrangement shown in FIG. 1, light mud conditioned by degasser 22 and shakers 24 is pumped from drilling fluid tank 28 via pumps 28P and into drillstring 60 via the inlet conduit 16 which extends between drillstring 60 and drilling fluid tank 28.

Drilling system 10 additionally includes a marine riser 40 having a first or upper end 40A disposed at or near the rig floor 14 of vessel 12 and a second or lower end 40B disposed at or near a blowout preventer (BOP) 102 of wellhead system 100. In this embodiment, riser 40 is supported by a slip joint 42 coupled to vessel 12. Additionally, riser 40 includes an annular containment or rotating control device (RCD) 44 disposed below the waterline 9 and configured to seal an annulus 45 formed between an inner surface of riser 40 and an outer surface of drillstring 60. Particularly, RCD 44 divides annulus 45 into a first or upper annulus 45A extending between RCD 44 and the upper end 40A of riser 40 and a second or lower annulus 45B extending from RCD 44 and into wellbore 2. In some embodiments, RCD 44 may be configured to seal against the outer surface of drillstring 60 as drillstring 60 rotates about a central or longitudinal axis thereof relative to riser 40. Further, riser 40 also includes a subsea pump 46 disposed below the waterline 9 that is powered by a fluid motor 48 coupled to subsea pump 46. Fluid communication between the lower annulus 45B and subsea pump 46 is provided by a pump conduit 47 extending therebetween. In some embodiments, subsea pump 46 may be positioned thousands of feet (ft) below waterline 9. For instance, in an embodiment, subsea pump 46 may be positioned approximately 1,500-2,000 ft below the waterline 9 in an offshore application where mudline 5 is disposed approximately 4,000 ft below the waterline 9.

In this embodiment, a subsea pump conduit 34 extends between the pump 32P of seawater tank 32 and fluid motor 48. Subsea pump conduit 34 also includes a branch conduit 34B providing fluid communication between upper annulus 45A and seawater tank 32. Additionally, a hydrostatic fluid conduit 36 extends between the hydrostatic pump 30P of hydrostatic tank 30 and subsea pump 46. In this arrangement, seawater may be pumped from seawater tank 32 via seawater pump 32P through fluid motor 48 to drive subsea pump 46, where subsea pump 46 may be used to pump fluid between lower annulus 45B and hydrostatic tank 30 via hydrostatic conduit 36. In this embodiment, drilling system 10 further includes a centrifuge or separator 38 supported by the rig floor 14 of vessel 12, where centrifuge 38 is in fluid communication with upper annulus 45A via a centrifuge conduit 39 extending therebetween. Additionally, a branch conduit 39B also provides fluid communication between return conduit 18 and centrifuge 38. Centrifuge 38 is configured to separate drilling fluids from particulates or other debris, facilitating the conditioning of the light mud stored in drilling fluid tank 28.

In this embodiment, wellhead system 100 of drilling system 10 generally includes BOP 102, a wellhead connector 110, and a subsea wellhead 112. BOP 102 includes one or more actuatable sealing or closure elements to selectively isolate wellbore 2 from the surrounding environment (i.e., sea 7). Additionally, BOP 102 includes a choke line 104 and a kill line 106 that extend between BOP 102 and vessel 12, where lines 104 and 106 may be used to inject fluids into or from lower annulus 45B. Wellhead connector 110 provides a connection between BOP 102 and subsea wellhead 112 disposed at mudline 5, where wellhead 112 provides physical support to the components of wellhead system 100. Additionally, in other embodiments, wellhead system 100 of drilling system 10 may include components not shown in FIG. 1.

In this embodiment, subsea wellhead 112 is coupled with a first or upper casing string 114 that extends from wellhead 112 into wellbore 2 (traversing mudline 5) and terminates at a first or upper casing shoe or seat 116. In some embodiments, upper casing string 114 comprises a conductor casing string 114 and wellhead 112 comprises a wellhead conductor or outer housing 112. In some embodiments, upper casing string 114 comprises a 36" casing string; however, in other embodiments, the diameter of upper casing string 114 may vary. Upper casing string 114 lines a portion of an inner surface 4 of wellbore 2 and isolates the portion of inner surface 4 lined by upper casing string 114 from fluid pressure within wellbore 2 via cement positioned between the interface of inner surface 4 of wellbore 2 and the outer surface of upper casing string 114. In this configuration, an openhole or exposed portion 2E of wellbore 2 extending between casing shoe 116 and a lower terminal end 6 of wellbore 2 remains exposed to fluid pressure within wellbore 2. As will be discussed further herein, an upper end of a second or intermediate casing string having a smaller diameter than upper casing string 114 may be suspended from upper casing shoe 116 of upper casing string 114 as wellbore 2 is extended by the cutting action of a drill bit 72.

In this embodiment, drillstring 60 of drilling system 10 comprises a concentric drillstring or concentric drill pipe (CDP) 60 that includes an inner drillstring 62 extending within a coaxial outer drillstring 64, forming an annulus 65 therebetween. In this arrangement, fluid received from inlet conduit 16 flows into wellbore 2 via annulus 65 while returns circulated from wellbore 2 to return conduit 18 flow through a central bore or passage 66 of inner drillstring 62. In this embodiment, drilling system 10 includes a circulation head or swivel 120 coupled to the upper end 60A of drillstring 60 and a concentric valve 200 coupled to a second or lower terminal end 60B of drillstring 60. Additionally, a bottom hole assembly (BHA) 70 including drill bit 72 is coupled to concentric valve 200. BHA 70 may include sensors, instruments, motors, and other tools for actuating and/or controlling the operation of drill bit 72, where drill bit 72 is configured to cut into formation 3 at the lower end 6 of wellbore 2 to extend the length of wellbore 2. In this embodiment, BHA 70 also includes a float or check valve 74 configured to prevent fluids in wellbore 2 from reversing flow through drill bit 72 and into BHA 70. In this arrangement, a wellbore annulus 8 is formed between an outer surface of BHA 70 (as well as an outer surface of the lower end of drillstring 60) and the inner surface 4 of wellbore 2.

Figure 2:
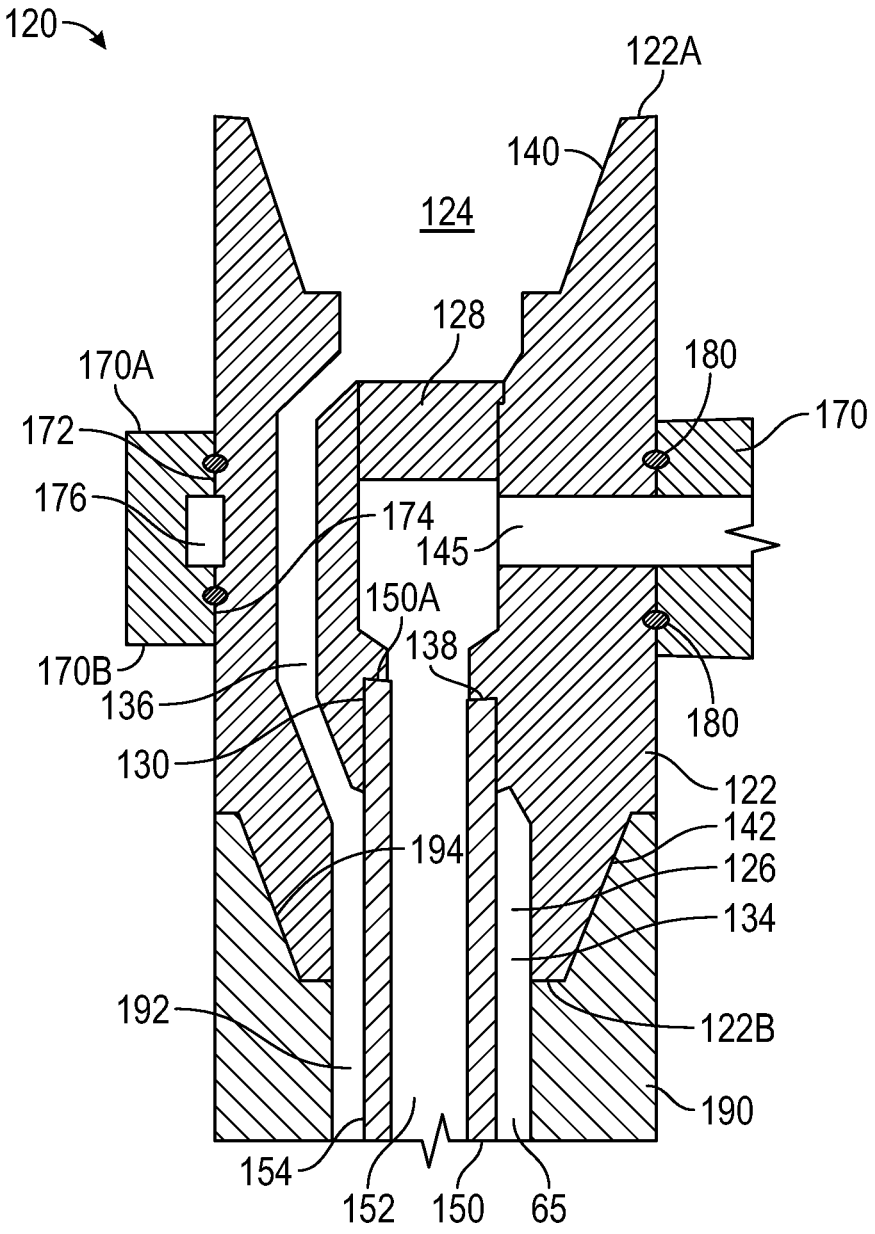
FIG. 2 is a side cross-sectional view of an embodiment of a circulation head of the well system of FIG. 1 in accordance with principles disclosed herein.

Referring now to FIGS. 1, 2, an embodiment of circulation head 120 of drilling system 10 is shown schematically in FIG. 2. Generally, circulation head 120 allows for the communication of fluid between drillstring 60 and conduits 16 and 18 while providing for relative rotation between drillstring 60 and vessel 12. In the embodiment shown in FIG. 2, circulation head 120 generally includes a circulation housing or body 122, an inner tubular member 150, and a rotational member or swivel 170. Circulation body 122 has a first or upper end 122A, a second or lower end 122B, a central first or upper bore or passage 124 extending partially into body 122 from upper end 122A, and a central second or lower bore or passage 126 extending partially into body 122 from lower end 122B. Upper passage 124 receives fluid flow from inlet conduit 16 while lower passage 126 provides fluid flow to return conduit 18.

In this embodiment, circulation body 122 includes a centrally disposed plug or terminating member 128 disposed axially between passages 124 and 126 and restricting fluid flow directly between passages 124 and 126. Additionally, lower passage 126 includes a centrally disposed receptacle 130 formed on an inner surface thereof for receiving the inner tubular member 150. In this embodiment, receptacle 130 includes an annular shoulder in engagement with or disposed directly adjacent inner tubular member 150. In some embodiments, the inner surface of receptacle 130 is threaded so as to threadably engage corresponding threads of inner tubular member 150; however, in other embodiments, receptacle 130 may comprise other mechanisms for releasably coupling with inner tubular member 150, such as via a lock ring or other member. In this arrangement, inner tubular member 150 extends through at least a portion of lower passage 126, forming an annulus 134 between an inner surface of lower passage 126 and inner tubular member 150, where annulus 134 forms a portion of the annulus 65 discussed above. Further, circulation body 122 includes one or more circumferentially spaced (if multiple) radial ports 145 that extend between an inner surface of lower passage 126 and an outer surface of body 122.

In this embodiment, circulation body 122 includes one or more bypass passages 136 extending directly between upper passage 124 and lower passage 126, thereby providing fluid communication therebetween. In some embodiments, body 122 includes a plurality of circumferentially spaced bypass passages 136, while in other embodiments, body 122 may only include a single bypass passage 136. Bypass passage 136 provides fluid communication between upper passage 124 and the annulus 134 formed in lower passage 126. In this arrangement, fluid communication between annulus 134 and a central bore or passage 152 of inner tubular member 150 is restricted via an annular seal 138 formed between receptacle 130 of circulation body 122 and inner tubular member 150. In some embodiments, seal 138 comprises one or more O-ring or other annular elastomeric seals known in the art and positioned radially between receptacle 130 and inner tubular member 150. However, in this embodiment, seal 138 comprises a metal-to-metal gastight seal 138 formed at an annular interface between receptacle 130 and inner tubular member 150.

In this embodiment, circulation body 122 includes a first or upper connector 140 disposed at upper end 122A and a second or lower connector 142 disposed at lower end 122B. Upper connector 140 comprises a female or box connector including an outer or primary shoulder, an inner or secondary shoulder, and a threaded inner surface extending therebetween. Conversely, lower connector 142 comprises a male or pin connector including an outer or primary shoulder, an inner or secondary shoulder, and a threaded outer surface extending therebetween. Thus, in the embodiment shown in FIG. 2, connectors 140 and 142 comprise rotary shouldered threaded connectors configured to releasably or threadably connect with corresponding rotary shouldered threaded connectors of other components of drillstring 60.

Particularly, in this embodiment, connectors 140 and 142 comprise double or dual shouldered threaded connectors that utilize both primary and secondary shoulders for forming threaded connections with other components of drillstring 60. However, in other embodiments, connectors 140 and 142 may comprise single-shouldered threaded connectors, or other releasable connectors known in the art other than threaded connectors. In some embodiments, at least one of the primary or secondary shoulders of connectors 140 and 142 of circulation body 122 is configured to provide a premium type connection affecting a gastight seal when engaged by the corresponding shoulder of an adjacent component of drillstring 60 made-up or coupled therewith, thereby forming a gastight seal between annulus 65 of drillstring 60 and the surrounding environment.

Given that standard threaded connectors may be used with circulation body 122, circulation body 122 may be coupled or made-up with conventional drill pipe joints, such as a conventional drill pipe joint 190 of drillstring 60 shown schematically in FIG. 2. Particularly, drill pipe joint 190 includes a central bore or passage 192, and a first or upper box connector 194, where box connector 194 is configured to threadably couple with the pin connector 142 of circulation body 122 to form a standard or conventional rotary shouldered threaded connection (RSTC) therebetween, where the RSTC is unaffected by the presence (i.e., is not reduced in thickness and does not include any additional passages) of bypass passage 136 in circulation body 122. Additionally, in this embodiment, the upper connector 140 of circulation body 122 is configured to releasably couple with a top drive assembly (or an intermediate component positioned between the top drive assembly and circulation head 120) such that top drive assembly may apply torque to upper connector 140 and circulation body 120 to thereby rotate circulation body 120 and other components of drillstring 60 attached thereto. In this embodiment, inner tubular member 150 comprises a portion of inner drillstring 62 of drillstring 60 while drill pipe joint 190 comprises a portion of outer drillstring 64.

In this embodiment, inner tubular member 150 has a first or upper end 150A, central bore or passage 152 extending from upper end 150A, and a generally cylindrical outer surface 154 also extending between upper end 150A and a lower end of inner tubular member 150. In this embodiment, the upper end 150A of inner tubular member 150 is received in the receptacle 130 of circulation body 122. In some embodiments, a portion of the outer surface 154 extending from upper end 150A is threaded for threadably connecting with receptacle 130. In this embodiment, the outer surface 154 of inner tubular member 150 includes an annular and radially outwards extending shoulder or landing profile (not shown) proximal a lower end of inner tubular member 150 for physically engaging a corresponding shoulder or landing profile disposed within another component of drillstring 60. In some embodiments, the outer surface 154 of inner tubular member 150 includes an annular seal assembly disposed therein proximal the lower end thereof for sealingly engaging an annular receptacle of another component of drillstring 60.

In this embodiment, swivel 170 of circulation head 120 is generally configured to provide for fluid communication between bore 66 of inner drillstring 62 and the return conduit 18 while drillstring 60 rotates (e.g., from a torque applied by a top drive assembly) relative vessel 12. In this embodiment, swivel 170 is generally annular in shape and includes a first or upper end 170A, a second or lower end 170B, and a central bore or passage 172 extending between ends 170A and 170B and defined by a generally cylindrical inner surface 174. The inner surface 174 of swivel 170 includes an annular channel or groove 176 disposed therein that is in fluid communication with one or more radial ports or passages 178 which are in fluid communication with return conduit 18. In this arrangement, a radial flowpath is formed that extends from lower passage 126 of circulation body 122, through radial port 145, into channel 176 of swivel 170, and from channel 176 into return conduit 18 via radial port 178. Further, given that channel 176 extends the entire circumference of swivel 170, fluid communication is provided between the radial port 145 of circulation body 122 and the radial port 178 of swivel 170 irrespective of the relative angular position of circulation body 122 and swivel 170.

In this embodiment, swivel 170 includes an annular seal assembly 180 positioned radially between the inner surface 174 of swivel 170 and the outer surface of circulation body 122 and flanking each axial end of channel 176, thereby restricting fluid communication between channel 176 and the surrounding environment. Additionally, seal assembly 180 is configured to seal between swivel 170 and circulation body 122 while circulation body 122 (and inner tubular member 150 coupled thereto) rotates relative swivel 170, which remains substantially stationary respective vessel 12. In this embodiment, seal assembly 180 comprises a plurality of axially spaced annular seals 180; however, in other embodiments, seal assembly 180 may comprise other sealing mechanisms known in the art. Further, the inner surface 174 of swivel 170 comprises a bearing positioned radially between inner surface 174 and the outer surface of circulation body 122 to permit relative rotation between body 122 and swivel 170. In some embodiments, the bearing may comprise a lubricated interface between inner surface 174 and the outer surface of circulation body 122, while in other embodiments, the bearing may comprise other bearings known in the art, including ball or needle bearings and the like.

Figure 3:
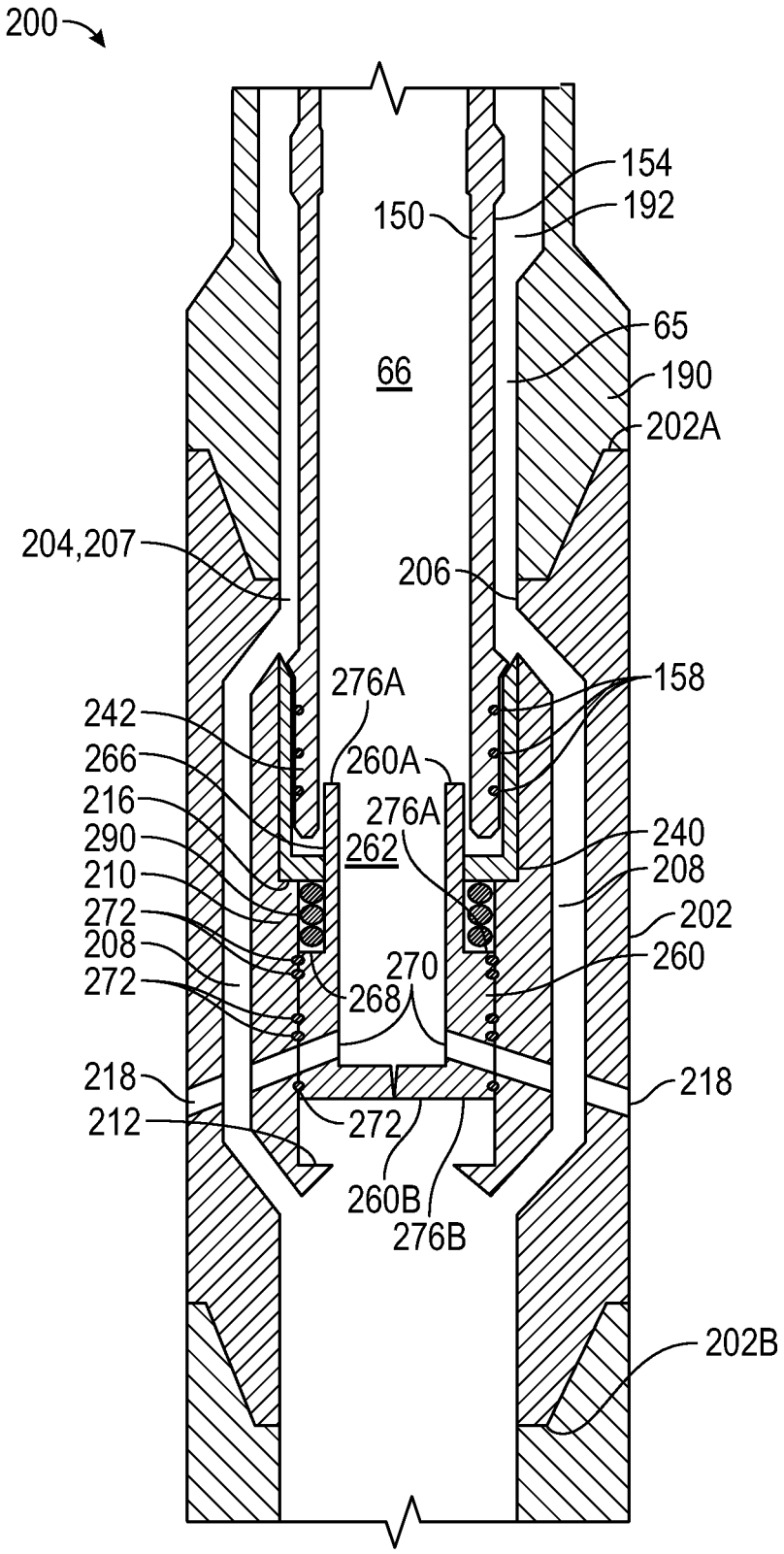
FIG. 3 is a side cross-sectional view of an embodiment of a concentric valve of the well system of FIG. 1 in accordance with principles disclosed herein.

Referring now to FIGS. 1, 3, an embodiment of concentric valve 200 of the drilling system 10 of FIG. 1 is shown schematically in FIG. 3. Concentric valve 200 is disposed at the lower end 60B of drillstring 60 and is generally configured to provide selective fluid communication between bore 66 of inner drillstring 62 and wellbore annulus 8. Additionally, concentric valve 200 is configured to provide fluid communication or crossover between annulus 65 of drillstring 60 and BHA 70.

In the embodiment shown in FIG. 3, concentric valve 200 generally includes a valve body or housing 202, an insert sleeve 240, and a flow piston 260 slidably disposed in valve body 202. Valve body 202 has a first or upper end 202A, a second or lower end 202B, a central bore or passage 204 extending between ends 202A and 202B and defined by a generally cylindrical inner surface 206. Valve body 202 additionally includes a plurality of circumferentially spaced bypass passages 208 extending between a portion of passage 204 disposed proximal upper end 202A and a portion of passage 204 disposed proximal lower end 202B. Additionally, an annulus 207 is formed between the inner surface 206 of valve body 202 and an outer surface 154 of an inner tubular member 150 extending into the upper end 202A of valve body 202. In this manner, bypass passages 208 provide for fluid flow between annulus 207 and the portion of passage 204 disposed at lower end 202B. In some embodiments, inner tubular member 150 shown in FIG. 3 may be the inner tubular member 150 suspended from circulation head 120 shown in FIG. 2; however, in other embodiments, drillstring 60 may include additional subs configured to physically support and suspend inner tubular members 150 such that drillstring 60 may include multiple inner tubular members 150.

In this embodiment, valve body 202 of concentric valve 200 includes a centrally disposed receptacle 210 around which bypass passages 208 extend, thereby allowing fluid flowing along annulus 65 to bypass or flow around receptacle 210. Receptacle 210 includes an annular shoulder or seat 212 formed at a lower end thereof, and an annular insert shoulder or seat 216. Insert sleeve 240 is generally cylindrical in shape and is received in a reduced diameter section of receptacle 210. In this embodiment, sleeve 240 includes a central bore defined by an inner sealing surface 242 and an annular, radially inwards extending flange disposed at a lower end of sleeve 240. Insert sleeve 240 additionally includes an annular landing shoulder or profile disposed at the upper end of sleeve 240 for engaging a landing shoulder of inner tubular member 150, thereby allowing for a lower end of tubular member 150 to be landed within insert sleeve 240 with a seal assembly 158 of member 150 in sealing engagement with inner sealing surface 242 of sleeve 240.

In this embodiment, sleeve 240 is releasably coupled (e.g., threadably coupled, coupled via a locking member, etc.) to the inner surface 206 of an upper portion of receptacle 210 (i.e., portion disposed above reduced diameter section 214) where the lower end of sleeve 240 is disposed directly adjacent or physically engages insert shoulder 216 of receptacle 210. In other embodiments, sleeve 240 may be formed integrally with receptacle 210 and valve bod 202 as a single, unitary component. Valve body 202 of concentric valve 200 additionally includes a plurality of circumferentially spaced angled or radial ports 218 that extend between the portion of passage 204 extending through receptacle 210 and an outer cylindrical surface of valve body 202. Radial ports 218 are angularly or circumferentially spaced from bypass passages 208, and thus, fluid communication is restricted between ports 218 and passages 208.

Flow piston 260 of concentric valve 200 is generally cylindrical in shape and is configured to provide selective fluid communication between passage 204 of valve body 202 and the surrounding environment (e.g., wellbore annulus 8). In this embodiment, flow piston 260 has a first or upper end 260A, a second or lower end 260B, a chamber 262 extending into piston 260 from upper end 260A, and a generally cylindrical outer surface 264 extending between ends 260A and 260B. The outer surface 264 of piston 260 includes a reduced diameter section 266 extending from upper end 260A that forms an annular shoulder 268. Reduced diameter section 266 of outer surface 264 is sized such that the upper portion of flow piston 260 defined by reduced diameter section 266 is permitted to pass through the flange of insert sleeve 240 while shoulder 268 is restricted from passing through the flange.

In this embodiment, a biasing member 290 (e.g., a coiled spring, a plurality of disc springs, a compressible fluid disposed in a sealed chamber, etc.) is disposed about the reduced diameter section 266 and extend axially between annular shoulder 268 of piston 260 and the flange of insert sleeve 240. In this arrangement, biasing member 290 is configured to apply an axial biasing force against flow piston 260 in the direction of seat 212 of valve body 202. In other words, when no net pressure force is applied to flow piston 260, biasing member 290 biases piston 260 towards seat 212 such that the lower end 260B of piston 260 is disposed directly adjacent or physically engages seat 212.

In this embodiment, flow piston 260 of concentric valve 200 includes a plurality of circumferentially spaced angled or radial ports 270 disposed proximal lower end 260B, where radial ports 270 extend radially between outer surface 264 and chamber 262. Additionally, the outer surface 264 of piston 260 includes an annular seal assembly 272 in sealing engagement with the inner surface 206 of valve body 202. In this embodiment, seal assembly 272 comprises a plurality of axially spaced elastomeric seals 272 that flank radial ports 270; however, in other embodiments, seal assembly 270 may comprise other sealing mechanisms or interfaces known in the art.

In this embodiment, flow piston 260 of concentric valve 200 comprises a first or open position (shown in FIG. 3) and a second or closed position axially spaced from the open position. Particularly, in the open position, the lower end 260B of piston 260 is axially spaced from seat 212 with biasing member 290 in a compressed position (relative the open position of piston 260) and radial ports 270 of piston 260 axially aligned with radial ports 218 of valve body 202 to permit fluid communication therebetween, and thus, between wellbore annulus 8 and the chamber 262 of piston 260. In the closed position of flow piston 260, lower end 260B of piston 260 is disposed directly adjacent or physically engages seat 212 of valve body 202 while the radial ports 270 of piston 260 are axially misaligned with the radial ports 218 of body 202, restricting fluid communication between radial ports 218 and the chamber 262 of piston 260. In this position, fluid communication between wellbore annulus 8 and the bore 66 of inner drillstring 62 is restricted via seal assembly 272 of piston 260. However, fluid flow is still permitted to travel between annulus 207 and the lower end of passage 204.

Flow piston 260 of concentric valve 200 is actuatable between the open and closed positions in response to differences in fluid pressure in the bore 66 of inner drillstring 62 and annulus 65 of drillstring 60. Particularly, in this embodiment, piston 260 comprises a first or upper annular piston area 276A that receives fluid pressure from bore 66 of inner drillstring 62 and a second or lower annular piston area 276B that receives fluid pressure from annulus 65 of drillstring 60. In this embodiment, upper piston area 276A generally includes the upper end 260A and shoulder 268 of piston 260 while the lower piston area 276B generally includes the lower end 260B of piston 260, where piston areas 276A and 276B are substantially similar in size. In this arrangement, when fluid pressure in bore 66 proximal valve 200 is equal to fluid pressure in annulus 65 proximal valve 200, no net pressure force is applied to piston 260 and biasing member 290 acts to hold piston 260 in the closed position. However, if fluid pressure in annulus 65 increases a to sufficient degree greater than fluid pressure in bore 66, an axially directed upwards net pressure force is applied to piston 260 sufficient to overcome the downwards biasing force provided by biasing member 290 to actuate piston 260 from the closed position to the open position shown in FIG. 3. In some embodiments, the sufficient net pressure force is applied to piston 260 when fluid is actively pumped through annulus 65 via pumps 28P of vessel 12. However, at times pumping into drillstring 60 may be ceased, such as when drill pipe joints or stands are being added to drillstring 60, at which point biasing member 290 actuates piston 260 into the closed position to prevent fluids in wellbore 2 from uncontrollably flowing upwards into drillstring 60 through bore 66 of inner drillstring 62.

Figure 4:
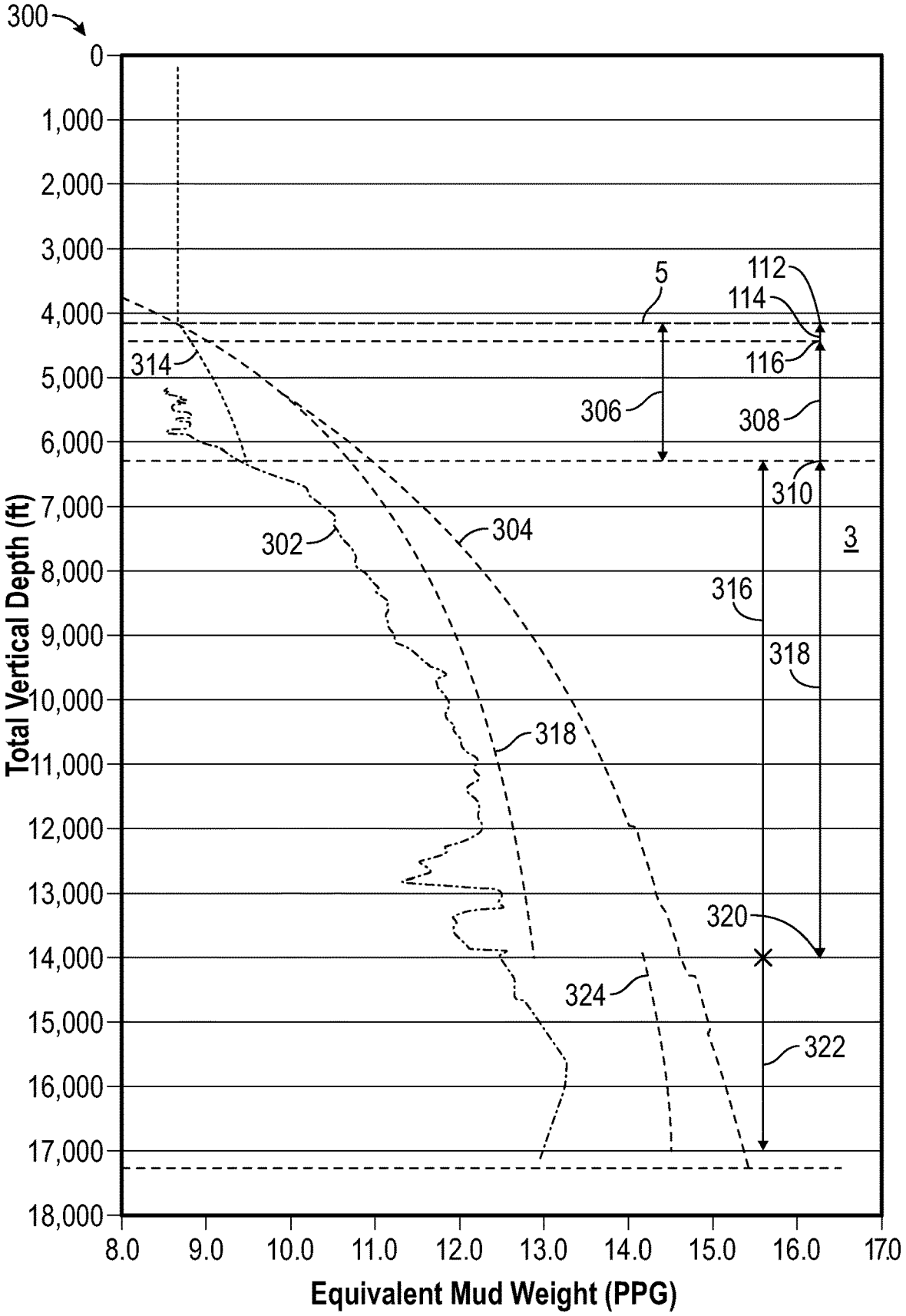
FIG. 4 is a graphical representation of a pressure versus depth profile of a wellbore in accordance with principles disclosed herein.

Referring now to FIGS. 1 and 4, an embodiment of a drilling operation of the drilling system 10 of FIG. 1 is shown graphically in a chart 300 of FIG. 4. Particularly, the Y-axis of chart 300 represents total vertical depth (TVD) in ft extending vertically downwards from the rig floor 14 of vessel 12 while the X-axis of chart 300 represents fluid pressure as equivalent mud weight (EMW) in PPG, where EMW expresses fluid pressure in terms of fluid density. For instance, in some embodiments, an EMW of 12.0 PPG at 14,000 ft TVD is equivalent to the hydrostatic pressure or head produced by a 14,000 ft vertical column of fluid having a density of 12.0 PPG. Additionally, chart 300 illustrates a pore pressure profile 302 and a fracture pressure profile 304 of the formation 3. Not intending to be bound by theory, in some embodiments, EMW at a particular TVD may be calculated by dividing the fluid pressure at the particular TVD by the product of the depth in TVD multiplied by 0.052.

Generally, pore pressure profile 302 of chart 300 represents fluid pressure in the pore space of formation 3 at a given TVD while fracture pressure profile 304 of chart 300 represents the degree of fluid pressure sufficient to hydraulically fracture formation 3 at a given TVD. The pressure profiles 302 and 304 of formation 3 shown in FIG. 4 represent a single example or embodiment of formation 3, and in other embodiments, the pressure profiles 302 and 304 shown in chart 300 may vary. Thus, in order to prevent an influx of formation fluid from formation 3 into wellbore 2, fluid pressure within the exposed portion 2E of wellbore 2 must be maintained above (i.e., to the right in chart 300) the pore pressure profile 302 at the given TVD and below (i.e., to the left in chart 300) the fracture pressure profile 304 at the given TVD to prevent fluid pressure in the exposed portion 2E of wellbore 2 from hydraulically fracturing the formation 3. As discussed above, upper casing string 114 supports wellhead 112 and seals the portion of inner surface 4 of wellbore 2 covered by string 114 from fluid pressure within wellbore 2. In the embodiment of FIGS. 1 and 4, mudline 5 is disposed approximately 4,100 ft from rig floor 14, while the targeted TVD of wellbore 2 (when completed) is approximately 17,000 ft; however, in other embodiments, the TVD of mudline 5 and wellbore 2 may vary.

A drilling operation performed by the drilling system 10 shown in FIG. 1 may proceed in several stages. In this embodiment, a first stage of a drilling operation performed by drilling system 10 comprises drilling into formation 3 from mudline 5 to a TVD of approximately 6,200 ft (i.e., 1,100 ft TVD beneath mudline 5) without riser 40, as shown schematically in FIG. 4 by arrow 306. Particularly, following the installation of vessel 12 at the wellsite, wellbore 2 may be initially formed by drillstring 60, with an outer surface of outer drillstring 64 exposed to the sea 7, such that wellhead 112 and upper casing string 114 suspended therefrom (shown schematically in FIG. 4) can be installed at the mudline 5. Upper casing string 114 extends from wellbore 112 to the upper casing seat 116 (shown schematically in FIG. 4), which, in this embodiment, is disposed at a TVD of approximately 4,300 ft (approximately 200 ft below the mudline 5). Following installation in wellbore 2, upper casing string 114 may be cemented to secure string 114 to the inner surface 4 of wellbore 2.

During the riserless drilling interval 306 in this embodiment, neither BOP 102 nor riser 40 of drilling system 10 have been installed, and thus, drilling fluid circulated into wellbore 2 from vessel 12 is dumped to the surrounding environment (e.g., the sea 7) after it has been recirculated or displaced from the wellbore 2. Particularly, drilling fluid is pumped via pumps 28P from drilling fluid tank 28 into annulus 65 of drillstring 60, and from annulus 65 into wellbore annulus 8 via jets disposed in drill bit 72. The drilling fluid disposed in wellbore annulus 8 may then be circulated into the sea 7 as wellbore 2 is further drilled during the riserless drilling interval 306. In other embodiments, recirculated drilling fluid may be communicated to vessel 12 via a subsea pump instead of being dumped to the surrounding environment. Additionally, although drillstring 60 is described in this embodiment as being used to drill wellbore 2 during the riserless drilling interval 306, in other embodiments, a conventional drillstring (i.e., a drillstring that is not a CDP drillstring) may be used during the riserless drilling interval 306.

During riserless drilling interval 306, wellbore annulus 8 is exposed to or in fluid communication with the surrounding environment (e.g., the sea 7). In this configuration, a bottomhole (i.e., the portion of wellbore 2 at wellbore terminal end 6) EMW 314 during the riserless drilling interval 306 is determined by the TVD between the waterline 9 and mudline 5 and the density of the seawater disposed therebetween, and the TVD of wellbore 2 and the density of fluid disposed in wellbore 2. Thus, as indicated in the chart 300 of FIG. 4, the fluid pressure near the opening of wellbore 2 (i.e., proximal to, but below 4,100 ft TVD) is equivalent to approximately 8.6 PPG in EMW, the density of the fluid disposed between mudline 5 and waterline 9 (i.e., seawater). However, bottomhole BMW 314 during the riserless drilling interval 306 increases as TVD increases. The increase in bottomhole BMW 314 as TVD increases is due to the lengthening in TVD of wellbore 2, and the relatively greater density of the drilling fluid pumped through wellbore annulus 8 by pumps 28P of vessel 12.

For instance, in this embodiment, drilling fluid pumped by pumps 28P is approximately 12.5 PPG. Thus, as wellbore 2 increases in TVD, the TVD of the column of drilling fluid disposed in wellbore annulus 8 also increases. Given that chart 300 represents fluid pressure on the X-axis in terms of EMW (pressure being a function of EMW and depth), EMW will increase as TVD increases when the fluid density of the column above the given TVD increases, given that the increased density above results in greater hydrostatic pressure at the given TVD. In other words, given that wellbore annulus 8 is filled with drilling fluid having a greater density than the seawater of sea 7 disposed directly above wellbore annulus 8 (12.5 PPG versus 8.6 PPG, respectively, in this embodiment), the increase in depth of wellbore 2 during drilling increases the height or depth of the column of drilling fluid disposed in wellbore annulus 8 while the column of seawater in sea 7 above wellbore annulus 8 remains the same in height, resulting in the fluid disposed in an upper terminal end of wellbore annulus 8 (i.e., at mudline 5) having a lower EMW than fluid disposed in a lower terminal end of wellbore annulus 8 (i.e., at wellbore terminal end 6).

In this embodiment, once wellbore 2 has been drilled to a TVD of approximately 2,200 ft from the mudline 5, an intermediate casing string 308 (shown schematically in FIG. 4) is installed in wellbore 2 to seal the inner surface 4 of the portion of wellbore 2 drilled during the riserless drilling interval 306 from fluid pressure within wellbore 2. Intermediate casing string 308 is suspended from the casing shoe 116 of upper casing string 114, and extends through wellbore 2 to a lower terminal end comprising an intermediate casing seat or shoe 310. In this embodiment, intermediate casing seat 310 is disposed at a TVD of approximately 6,300 ft (approximately 2,200 ft TVD from the mudline 5). In some embodiments, intermediate casing string 308 comprises a 22" casing string; however, in other embodiments, the size of intermediate casing string 308 may vary. Following installation in wellbore 2, intermediate casing string 308 may be cemented to secure string 308 to the inner surface 4 of wellbore 2.

In this embodiment, with intermediate casing string installed in wellbore 2, the riserless drilling interval 306 is completed. At this stage, BOP 102, riser 40, and the other components of drilling system 10 shown in FIG. 1 are assembled. Following the full assembly of drilling system 10, drillstring 60 is extended or run through riser 40 and inserted into wellbore 2 such that bit 72 is positioned proximal the wellbore terminal end 6, which is located at a TVD substantially equal to the TVD of intermediate casing seat 310. In some embodiments, with drillstring 60 disposed in wellbore 2, drilling fluid from drilling fluid tank 28 is pumped through the annulus 65 of drillstring 60 and into wellbore 2 via nozzles in drill bit 72 to form a bubble or pocket 50 (shown in FIG. 1) of drilling fluid in wellbore 2. Particularly, the drilling fluid bubble 50 extends between the wellbore terminal end 6 and an upper terminal end or drilling fluid interface 55 disposed in wellbore 2.

In this embodiment, drilling fluid from drilling fluid tank 28 is circulated into wellbore 2 until the fluid interface 55 of drilling fluid bubble 50 extends above the radial ports 218 (shown schematically in FIG. 1) of concentric valve 200 (i.e., until radial ports 218 are disposed within drilling fluid bubble 50), at which point hydrostatic fluid from hydrostatic tank 30 is pumped into the lower annulus 45B via hydrostatic conduit 36, subsea pump 46, and pump conduit 47. In this manner, hydrostatic fluid is prevented from inadvertently entering the radial ports 218 of concentric valve 200. Hydrostatic fluid flowing into lower annulus 45B via pump conduit 47 settles against the fluid interface 55 of drilling fluid bubble 50. In this embodiment, the hydrostatic fluid disposed in lower annulus 45B has a density of approximately 14.0 PPG; however, in other embodiments, the density of the hydrostatic fluid may vary. Additionally, although in this embodiment fluid bubble 50 is constructed prior to filling lower annulus 45 with hydrostatic fluid from hydrostatic tank 30, in other embodiments, hydrostatic fluid from tank 30 may be pumped into lower annulus 45B either before or at the same time as drilling fluid is pumped into wellbore 2 via drillstring 60.

In this embodiment, a predetermined column or depth of hydrostatic fluid 35 (shown in FIG. 1) is pumped into lower annulus 45B corresponding to a predetermined or desired bottom hole pressure (BHP) (i.e., fluid pressure at the wellbore terminal end 6), where the desired BHP is at least partly a function of the height of the column of hydrostatic fluid 35 disposed in lower annulus 45B and the density of the hydrostatic fluid. Thus, as the column of hydrostatic fluid 35 increases in height, the hydrostatic pressure applied against drilling fluid bubble 50 by the hydrostatic fluid at fluid interface 55 correspondingly increases, with maximum fluid pressure corresponding to the BHP of fluid at the wellbore terminal end 6. In this embodiment, the upper annulus 45A extending between the upper end 40A of riser 40 and the seal formed by RCD 44 is filled with a low density fluid, such as air or an inert gas, such that fluid disposed in upper annulus 45A applies minimal or substantially zero hydrostatic pressure to fluid disposed in lower annulus 45B.

As hydrostatic fluid is pumped into lower annulus 45B via pump conduit 47, drilling fluid pumped into wellbore 2 from drillstring 60 is recirculated to the drilling vessel 12 via central passage 66 of drillstring 60. In this arrangement, the level (in terms of TVD) of fluid interface 55 may be determined or monitored from the fluid flow rates in inlet conduit 16 and return conduit 18. For instance, if the flow rate in the inlet conduit 16 is greater than the flow rate in return conduit 18, then the TVD of fluid interface 55 may decrease (i.e., the fluid interface 55 may move upwards towards the mudline 5) as the volume of drilling fluid bubble 50 increases. Conversely, if the flow rate in the inlet conduit 16 is less than the flow rate in return conduit 18, then the TVD of fluid interface 55 may increase (i.e., the fluid interface may move downwards towards terminal end 6 of wellbore 2) as the volume of drilling fluid bubble 50 decreases. Additionally, in this embodiment, the volume of drilling fluid bubble 50, and in-turn, the position of fluid interface 55 relative radial ports 218 of valve 200, may be adjusted or controlled using the choke manifold 20 of return conduit 18. Particularly, by increasing backpressure in the central passage 66 of drillstring 60 via closing choke manifold 20, the volume of drilling fluid bubble 50 in wellbore 2 may be increased. Conversely, by increasing backpressure in the central passage 66 of drillstring 60 via opening choke manifold 20, the volume of drilling fluid bubble 50 in wellbore 2 may be decreased. Thus, by varying the restriction to fluid flow through central passage 66 of drillstring 60 and return conduit 18 via choke manifold 20, the volume of drilling fluid bubble 50 may be controlled as wellbore 2 is drilled by drilling system 10.

In this embodiment, prior to the resumption of drilling of the wellbore 2 by drill bit 72, lower annulus 45B is filled with hydrostatic fluid to form the column 35 at the predetermined height mentioned above. Particularly, the predetermined height of hydrostatic fluid column 35 is configured such that, upon the resumption of drilling the wellbore 2, BHP will be greater than the pore pressure profile 302 but less than the fracture pressure profile 304 of the formation 3 at the TVD corresponding to the TVD of the wellbore terminal end 6 (approximately 6,300 ft in this embodiment). In this manner, once drilling is resumed and the wellbore terminal end 6 extends beneath intermediate casing seat 310 (i.e., wellbore terminal end 6 being disposed at a greater TVD than intermediate casing seat 310), the BHP at wellbore terminal end 6 will be both great enough to prevent a rapid influx of formation fluids from formation 3 into wellbore 2 and low enough to prevent fracturing of the formation 3 beneath intermediate casing seat 310. In other embodiments, a combination of hydrostatic pressure applied to drilling fluid bubble 50 by the hydrostatic fluid column 35 and backpressure applied to the drilling fluid bubble 50 by choke manifold 20 may be relied upon to provide the predetermined or desired amount of BHP in view of the pore and fracture pressure profiles 302 and 304, respectively, of formation 3. In this embodiment, the predetermined height of hydrostatic fluid column 35 is approximately 1,600 ft TVD. In other words, in this embodiment, lower annulus 45B is filled with hydrostatic fluid from hydrostatic tank 30 until an upper end 37 of the hydrostatic fluid column 35 is disposed approximately 1,600 ft TVD from rig floor 14.

In this embodiment, the upper end 37 of hydrostatic fluid column 35 is disposed at the seal formed by RCD 44. In this configuration, although the seal provided by RCD 44 restricts the upper end 37 of hydrostatic fluid column 35 from being further raised towards the rig floor 14, in some embodiments, additional BHP may be provided when desired by operating subsea pump 46 and/or hydrostatic pump 30P to pressurize the hydrostatic fluid column 35 to, in-turn, pressurize drilling fluid bubble 50 and increase BHP. Thus, besides adjusting the amount of hydrostatic fluid disposed in lower annulus 45B, an operator of drilling system 10 may also control BHP by adjusting the pressure applied to the hydrostatic column 35 by subsea pump 46 and/or hydrostatic pump 30P. Additionally, in other embodiments, fluid may be added or removed (as well as pressurized or depressurized) to upper annulus 45A, with fluid pressure in upper annulus 45A being transmitted to lower annulus 45B, to provide further control of the BHP.

Once hydrostatic fluid column 35 has been formed to the predetermined column height, drilling of wellbore 2 may be resumed using drillstring 60 to extend wellbore terminal end 6 below intermediate casing seat 310. Particularly, in this embodiment, wellbore 2 is drilled until the wellbore lower end 6 reaches approximately 14,000 ft TVD (this bubble drilling interval is indicated by arrow 316 in FIG. 4). During the bubble drilling interval 316, hydrostatic fluid from hydrostatic tank 30 is continually pumped into lower annulus 45B at a volumetric rate substantially equal to the rate of volumetric increase in the wellbore 2 as drill bit 72 cuts into the formation 3. Additionally, the volume of drilling fluid bubble 50 is also substantially preserved during the bubble drilling interval 316. Thus, during the bubble drilling interval 316, the position or TVD of the upper end 37 of hydrostatic fluid column 35 remains substantially the same as the length of column 35 increases with the continuing increase in TVD of the fluid interface 55 as wellbore 2 extends deeper into formation 3.

The increase in vertical depth of the hydrostatic column 35 increases BHP during the bubble drilling interval 316, and provides a curved bubble drilling bottomhole EMW 318. Bottomhole EMW 318 curves as bottomhole TVD increases from approximately 6,300 ft to 14,000 ft due to the increasing predominance of the hydrostatic fluid column 35 relative to the column of air disposed in upper annulus 45A. Specifically, in this embodiment, at a bottomhole TVD of approximately 6,300 ft, approximately 1,600 ft TVD comprises air (air having a PPG of near zero) while approximately 4,700 ft TVD comprises hydrostatic fluid; and at a bottomhole TVD of approximately 14,000 ft, approximately 1,600 ft TVD comprises air while approximately 12,400 ft TVD comprises hydrostatic fluid. For instance, as bottomhole TVD of wellbore 2 increases, a greater share or percentage of the overall TVD between the rig floor 14 and wellbore terminal end 6 comprises the relatively dense hydrostatic fluid. In other words, if the bottomhole TVD of wellbore 2 were increased indefinitely, the bottomhole EMW 318 would asymptotically approach the density (in PPG) of the hydrostatic fluid.

By maintaining the position in TVD of the upper end 37 of hydrostatic fluid column 35 while also maintaining a constant volume of drilling fluid in the drilling fluid bubble 50, the bottomhole EMW 318 of bubble drilling interval 316 may be curved to mirror the curved trajectories of the pore and fracture pressure profiles 302 and 304, respectively, of formation 3. With bottomhole EMW 318 having a curved profile similar to the profile of profiles 302 and 304 of formation 3, wellbore 2 may be drilled to a greater TVD during bubble drilling interval 316 before bottomhole EMW 318 intersects pore pressure profile 302. By providing a curved bottomhole EMW profile 318, the overall TVD of bubble drilling interval 316 may be maximized before an additional casing string must be installed to protect the exposed or uncased portion of the inner surface 4 of wellbore 2. Therefore, by maximizing the TVD of bubble drilling interval 316, the overall number of casing strings installed in wellbore 2 may be reduced, thereby reducing the time and expense of drilling wellbore 2 to the target TVD, and increasing the available diameter of wellbore 2 proximal wellbore terminal end 6. For instance, given that each successive casing string must have a diameter less than a diameter of the preceding casing string, a wellbore having fewer casing strings will generally maintain more of its maximum diameter at bottomhole TVD than a wellbore having relatively more casing strings and the same bottomhole TVD.

In this embodiment, once wellbore terminal end 6 is drilled to a TVD of approximately 14,000 ft, bottomhole EMW 318 approaches the pore pressure profile 302 of formation 3, and thus, drilling is ceased and a third or lower casing string 318 (shown schematically in FIG. 4) is run into and installed in wellbore 2. Lower casing string 318 includes an upper end suspended from intermediate casing shoe 310 and a lower end that comprises a third or lower casing seat or shoe 320 disposed at a TVD of approximately 14,000 ft. In this embodiment, lower casing string 318 comprises either a 14" casing string or a 9⅞" casing string; however, in other embodiments, the diameter of lower casing string 318 may vary. As lower casing string 318 is run into wellbore 2, fluid disposed in wellbore 2 may be displaced by the volume of string 318. Displacement of wellbore fluid in response to running in lower casing string 318 may increase the height or position of the upper end 37 of hydrostatic fluid column 35. Thus, in order to maintain the position of upper end 37, hydrostatic fluid may be pumped from lower annulus 45 into hydrostatic tank 30 via subsea pump 46. Beyond adjusting for the running in of lower casing string 318, subsea pump 46 may be used to pump fluid from lower annulus 45B for other reasons, such as to control BHP during drilling. Once lower casing string 318 is run into or positioned in wellbore 2, lower casing string 318 is cemented to the inner surface 4 of wellbore 2 to isolate the portion of inner surface 4 covered by lower casing string 318 from fluid pressure in wellbore 2.

In this embodiment, once lower casing string 318 is cemented into position in wellbore 2, wellbore 2 may be further drilled as part of a second bubble drilling interval 322 extending between approximately 14,000 ft TVD and approximately 17,000 ft TVD, corresponding to a target TVD of wellbore 2. Prior to the initiation of the second bubble drilling interval 322, hydrostatic fluid is pumped from lower annulus 45B via subsea pump 36 and replaced with a second hydrostatic fluid having a relatively greater density than the first hydrostatic fluid it replaced in lower annulus 45B. In other words, at least some of the first hydrostatic fluid disposed in lower annulus 45B, having a first density, is replaced with the second hydrostatic fluid having a second density that is greater than the first density.

The increase in density of the hydrostatic fluid comprising hydrostatic fluid column 35 shifts the bottomhole EMW 324 of second bubble drilling interval 322 to the right in FIG. 4, such that the bottomhole EMW 324 at 14,000 ft TVD is proximal to, but less than, the fracture pressure 304 of formation 3 at 14,000 ft TVD. Thus, the margin or difference between the bottomhole EMW 324 and the pore pressure profile 302 of formation 3 at 14,000 ft TVD is sufficient to allow wellbore 2 to be drilled to completion without allowing bottomhole EMW 324 to approach pore pressure profile 302 at the target TVD of wellbore 2 (approximately 17,000 ft in the example of FIG. 4). In other embodiments, sufficient bottomhole EMW 324 may be obtained with increasing the density of fluid in upper annulus 45A, applying increased backpressure via choke manifold 20, and/or pressurizing lower annulus 45B via subsea pump 46 and/or hydrostatic pump 30. Once wellbore 2 has been drilled to the target TVD, a production liner (not shown) may be installed in wellbore 2 below lower casing string 318 to prepare wellbore 2 for the production of hydrocarbons from formation 3.

Although bubble drilling intervals 316 and 322 are described above as performed by a drilling system 10 including a marine riser 40, in other embodiments, a CDP drillstring similar to drillstring 60 may be employed without a surrounding riser for performing a bubble drilling interval, similar to intervals 316 and 322 described above. For instance, in an embodiment, wellhead system 100 may comprise a RCD similar to RCD 44 for sealing wellbore 2 from the surrounding environment (i.e., the sea 7). In this embodiment, drilling fluid is circulated between the drilling vessel 12 and the drilling fluid bubble 50 disposed in wellbore 2 via drillstring 60. Additionally, instead of using the hydrostatic fluid column 35 to provide desired BHP, high density fluid may be injected into the annulus 8 of wellbore 2 from the wellhead or a device coupled to the wellhead. In this manner, wellbore 2 may be filled with a fluid at the mudline 5 having a density similar to the density of the formation 3 through which the wellbore 2 extends. By matching the density of fluid disposed in wellbore 2 with the density of the material comprising the surrounding formation 3, a BHP disposed between the pore and fracture profiles of the formation may be achieved without applying pressure from a high density (i.e., greater than the density of seawater) column of fluid extending above the mudline 5. Additionally, although the embodiment of drilling system 10 of FIGS. 1 and 4 includes only a single hydrostatic fluid to be used at any given time, in other embodiments, drilling system 10 may use several distinct hydrostatic fluids positioned in riser 40 at the same time to manage pressure in the wellbore 2. For instance, two separate hydrostatic fluids may be supplied to the lower annulus 45B with one hydrostatic fluid having a different density and/or other fluid properties than the other hydrostatic fluid.

While exemplary embodiments have been shown and described, modifications thereof can be made by one skilled in the art without departing from the scope or teaching herein. The embodiments described herein are exemplary only and are not limiting. Many variations and modifications of the system and apparatus are possible and will become apparent to those skilled in the art once the above disclosure is fully appreciated. For example, the relative dimensions of various parts, the materials from which the various parts are made, and other parameters can be varied. Furthermore, thought the openings in the plate carriers are shown as circles, they may include other shapes such as ovals or squares. Accordingly, it is intended that the following claims be interpreted to embrace all such variations and modifications.

What is claimed is:

1. A well system, comprising:

a drilling vessel;

a concentric drillstring extending from the vessel into a subterranean wellbore disposed beneath a mudline, wherein the concentric drillstring is configured to circulate a drilling fluid from the drilling vessel into the wellbore along a first passage, and to circulate the drilling fluid from the wellbore to the drilling vessel along a second passage; and a subsea pump in fluid communication with the wellbore, wherein the subsea pump is configured to manage fluid pressure in the wellbore by controlling a height of a column of hydrostatic fluid disposed in the wellbore which contacts the drilling fluid in the wellbore entirely across an annular fluid interface extending between an outer surface of the concentric drillstring and a wall of the wellbore and formed between the hydrostatic fluid and the drilling fluid.

2. The well system of claim 1, wherein the hydrostatic fluid has a greater density than the drilling fluid.

3. The well system of claim 1, further comprising:

a blowout preventer located at the mudline and through which the concentric drillstring extends;

a marine riser extending between the drilling vessel and the blowout preventer, wherein the column of hydrostatic fluid is disposed at least partially in an annulus formed between the outer surface of the concentric drillstring and an inner surface of the marine riser.

4. The well system of claim 3, further comprising a rotating control device (RCD) positioned vertically above the blowout preventer and along the marine riser and configured to seal against the outer surface of the concentric drillstring while permitting relative rotation between the drillstring and the marine riser, and wherein the column of the hydrostatic fluid extends from the fluid interface to the RCD.

5. The well system of claim 4, wherein the RCD divides the annulus into an upper annulus in which air is disposed and a lower annulus in which at least a portion of the column of hydrostatic fluid is disposed.

6. The well system of claim 1, further comprising a choke manifold disposed on the drilling vessel, wherein the choke manifold is configured to apply backpressure to the drilling fluid flowing from the wellbore to the drilling vessel through the second passage of the concentric drillstring.

7. The well system of claim 1, wherein a lower end of the concentric drillstring comprises a valve configured to provide fluid communication between the wellbore and the second passage of the concentric drillstring.

8. The well system of claim 1, further comprising:

a surface pump positioned on the drilling vessel and coupled to the concentric drillstring, the surface pump configured to pump the drilling fluid into and through the drillstring;

wherein a bubble of the drilling fluid is formed in the wellbore and which extends between a terminal end of the wellbore and the fluid interface, and wherein the surface pump and the subsea pump are configured to adjust a volume of the bubble of the drilling fluid.

9. A method of drilling a wellbore, comprising:

(a) pumping a drilling fluid from a drilling vessel into a wellbore through a first passage in a drillstring;

(b) flowing the drilling fluid from the wellbore to the drilling vessel through a second passage in the drillstring; and (c) pumping a first hydrostatic fluid into the wellbore using a subsea pump to manage fluid pressure in the wellbore whereby the first hydrostatic fluid contacts the drilling fluid in the wellbore entirely across an annular fluid interface extending between an outer surface of the drillstring and a wall of the wellbore and formed between the first hydrostatic fluid and the drilling fluid.

10. The method of claim 9, further comprising:

(d) pumping the hydrostatic fluid into a marine riser through which the drillstring extends to manage fluid pressure in the wellbore.

11. The method of claim 9, further comprising:

(d) applying backpressure to the drilling fluid flowing from the wellbore to the drilling vessel through the second passage in the drillstring using a choke manifold disposed on the drilling vessel.

12. The method of claim 9, further comprising:

(d) forming a bubble of drilling fluid in the wellbore, wherein the first hydrostatic fluid is positioned above the bubble of drilling fluid in the wellbore.

13. The method of claim 9, wherein the first hydrostatic fluid has a greater density than the drilling fluid.

14. The method of claim 9, further comprising:

(d) pumping the first hydrostatic fluid out of the wellbore using the subsea pump; and (e) pumping a second hydrostatic fluid into the wellbore using the subsea pump, wherein the second hydrostatic fluid has a greater density than the first hydrostatic fluid.

15. The method of claim 9, further comprising:

(d) forming a bubble of the drilling fluid in the wellbore which extends between a terminal end of the wellbore and the fluid interface; and (e) adjusting a volume of the bubble by adjusting at least one of a flow rate of the drilling fluid into the wellbore and a flow rate of the first hydrostatic fluid into the wellbore.

16. A well system, comprising:

a drilling vessel;

a drillstring extending from the vessel into a subterranean wellbore disposed beneath a mudline, wherein the drillstring is configured to circulate a drilling fluid from the drilling vessel into the wellbore along a first passage to form a bubble of drilling fluid positioned in the wellbore; and a subsea pump in fluid communication with the wellbore, wherein the subsea pump is configured to manage fluid pressure in the wellbore by controlling a height of a column of hydrostatic fluid disposed in the wellbore and positioned above the bubble of drilling fluid, wherein the hydrostatic fluid contacts the drilling fluid in the wellbore entirely across an annular fluid interface extending between an outer surface of the drillstring and a wall of the wellbore and formed between the hydrostatic fluid and the drilling fluid.

17. The well system of claim 16, wherein the hydrostatic fluid has a greater density than the drilling fluid.

18. The well system of claim 16, wherein the drillstring comprises a concentric drillstring configured to circulate the drilling fluid from the wellbore to the drilling vessel along a second passage.

19. The well system of claim 18, further comprising a marine riser positioned about the drillstring, and wherein the column of hydrostatic fluid is disposed at least partially in the marine riser.

20. The well system of claim 18, further comprising a choke manifold disposed on the drilling vessel, wherein the choke manifold is configured to apply backpressure to the drilling fluid flowing from the wellbore to the drilling vessel through the second passage of the drillstring.

21. The well system of claim 18, wherein a lower end of the drillstring comprises a valve configured to provide fluid communication between the wellbore and the second passage of the drillstring.

22. The well system of claim 19, further comprising a rotating control device (RCD) positioned along the marine riser and configured to seal against the outer surface of the drillstring while permitting relative rotation between the drillstring and the marine riser.

* * * * *